US008490531B2

(12) United States Patent
Simula et al.

(10) Patent No.: US 8,490,531 B2
(45) Date of Patent: Jul. 23, 2013

(54) MINE ROLLER NEUTRALIZATION SYSTEM

(75) Inventors: Glen Raymond Simula, Hancock, MI (US); Steven John Tarnowski, Calumet, MI (US); Luke Stephen Luskin, Hubbell, MI (US); William George Abbatt, Dearborn, MI (US)

(73) Assignee: GSE Technologies, LLC, Houghton, MI (US)

( * ) Notice: Subject to any disclaimer, the term of this patent is extended or adjusted under 35 U.S.C. 154(b) by 185 days.

(21) Appl. No.: 12/795,183

(22) Filed: Jun. 7, 2010

(65) Prior Publication Data

US 2011/0296976 A1 Dec. 8, 2011

(51) Int. Cl.
*B64D 1/04* (2006.01)

(52) U.S. Cl.
USPC ..... 89/1.13; 16/45

(58) Field of Classification Search
USPC ..... 102/402, 403; 86/50; 301/5.1–123
See application file for complete search history.

(56) References Cited

U.S. PATENT DOCUMENTS

| | | | | |
|---|---|---|---|---|
| 2,865,651 | A * | 12/1958 | Chayne et al. | 280/124.139 |
| 3,858,902 | A * | 1/1975 | Howells et al. | 280/6.159 |
| 4,202,393 | A * | 5/1980 | Ikeda et al. | 152/517 |
| 4,224,003 | A | 9/1980 | St. Louis | |
| 4,411,081 | A | 10/1983 | King | |
| 4,431,204 | A * | 2/1984 | Miyakoshi et al. | 280/277 |
| 4,526,249 | A * | 7/1985 | Parker | 180/219 |
| 4,732,507 | A | 3/1988 | Artzberger | |
| 4,759,659 | A | 7/1988 | Copie | |
| 4,765,432 | A * | 8/1988 | Odom | 180/227 |
| 4,909,128 | A | 3/1990 | Grinwald | |
| 4,913,581 | A | 4/1990 | Weiler | |
| 4,919,034 | A | 4/1990 | Firth | |
| 4,958,706 | A * | 9/1990 | Richardson et al. | 188/319.1 |
| 5,007,325 | A | 4/1991 | MacWatt | |
| 5,149,225 | A | 9/1992 | Artzberger | |
| 5,198,608 | A | 3/1993 | Cahill et al. | |
| 5,373,774 | A | 12/1994 | Akbar | |
| 5,712,441 | A | 1/1998 | Grunewald | |
| 5,844,160 | A | 12/1998 | Cieszkiewicz | |
| 5,988,037 | A | 11/1999 | Haughom et al. | |
| 6,026,135 | A | 2/2000 | McFee et al. | |
| 6,134,966 | A | 10/2000 | Donskoy et al. | |

(Continued)

FOREIGN PATENT DOCUMENTS

| | | | |
|---|---|---|---|
| GB | 2132567 | A | 7/1984 |
| GB | 2201643 | A | 9/1988 |

(Continued)

OTHER PUBLICATIONS

LTC Karl Borjes; The Self-Protective Adaptive Roller Kit (SPARK)—Negating the Improvised Explosive Device (IED) Threat for Soldiers and Vehicles; Army AL&T; Jan.-Mar. 2008 pp. 50-53.

(Continued)

*Primary Examiner* — Samir Abdosh
(74) *Attorney, Agent, or Firm* — Brooks Kushman P.C.

(57) ABSTRACT

A mine roller assembly for a mine roller is provided for detonating mines located in or on an underlying ground surface. A bracket is adapted for attachment to a mine roller system frame. An arm is pivotally connected to the bracket. A spring and damper system extends between the bracket and the arm. A wheel assembly is rotatably connected to the arm and is configured to interact with the underlying surface.

14 Claims, 4 Drawing Sheets

U.S. PATENT DOCUMENTS

| | | | | |
|---|---|---|---|---|
| 6,202,960 | B1 * | 3/2001 | Travis et al. | 244/103 R |
| 6,322,153 | B1 * | 11/2001 | Lund | 301/5.304 |
| 6,371,001 | B1 | 4/2002 | Schmid | |
| 6,382,069 | B1 | 5/2002 | Haughom et al. | |
| 6,568,030 | B1 * | 5/2003 | Watanabe et al. | 16/44 |
| 6,661,524 | B2 | 12/2003 | Smith et al. | |
| 6,802,237 | B1 | 10/2004 | Jones et al. | |
| 6,915,728 | B2 | 7/2005 | Renwick et al. | |
| 7,481,144 | B2 | 1/2009 | Simula et al. | |
| 2003/0145716 | A1 | 8/2003 | Dixon | |
| 2003/0145717 | A1 | 8/2003 | Yamamoto et al. | |
| 2004/0159060 | A1 | 8/2004 | Giri et al. | |
| 2005/0115388 | A1 | 6/2005 | Lowery et al. | |
| 2006/0266576 | A1 | 11/2006 | Eckhoff | |
| 2008/0067772 | A1 * | 3/2008 | Weagle | 280/124.134 |
| 2008/0073868 | A1 * | 3/2008 | Weagle | 280/124.1 |
| 2011/0084544 | A1 * | 4/2011 | Thorpe | 301/110.5 |

FOREIGN PATENT DOCUMENTS

| | | | |
|---|---|---|---|
| GB | 2461155 | A | 12/2009 |
| WO | 9315373 | A1 | 8/1993 |
| WO | 0201008 | A1 | 1/2002 |

OTHER PUBLICATIONS

Self-Protective Adaptive Roller Kit (SPARK); from PMCCS website copied Jan. 12, 2010; http://www.pica.army.mil/pmccs/D3IEDProtect/D3_IEDDefeat/SPARK.htm.

* cited by examiner

MINE ROLLER NEUTRALIZATION SYSTEM

The invention was made in part with Government support. The Government may have certain rights to the invention.

BACKGROUND

1. Technical Field

The invention relates to assemblies for a mine detonation apparatus.

2. Background Art

Systems for mine detonation include mechanical mine-clearing systems. The mechanical mine clearing system include both manned and remote control systems, and may be mechanical, and include rollers. Mine rollers may be attached to a vehicle such as a battle tank, armored vehicle or personnel carrier, vehicle, or the like. The vehicle may push or pull the rollers over the terrain, and the pressure from the roller contacting the ground detonates the mine or improvised explosive device (IED) placed in the terrain.

SUMMARY

In one embodiment, a mine roller assembly has a bracket, an arm, a spring and damper system, and a wheel assembly. The bracket is adapted for attachment to a mine roller system frame and has a first end region and a second end region. The arm has a first end region and a second end region where the first end region of the arm pivotally connects to the first end region of the bracket. The spring and damper system extends between the second end region of the bracket and the arm. The wheel assembly rotatably connects to the second end region of the arm, and is configured to interact with the underlying surface.

In another embodiment, a mine roller assembly has a bracket, an arm, a wheel assembly, and a spring and damper system. The bracket is adapted for attachment to a mine roller frame. The arm pivotally connects to the bracket. The wheel assembly rotatably connects to the arm. The spring and damper system extends between the bracket and the arm and has a damper system with a rebound damping rate and a compression damping rate. The rebound damping rate is higher than the compression damping rate to increase a ground following time of the wheel assembly with an underlying surface.

In a further embodiment, a system of mine roller assemblies has a first mine roller assembly with a first wheel assembly and a first axis of rotation and a second mine roller assembly with a second wheel assembly and a second axis of rotation. The first and second mine roller assemblies are adapted for attachment to the mine roller. The first and second rotational axes are offset from one another such that the first and second wheel assemblies are offset from one another.

In another embodiment, a method detonates a mine in or on an underlying surface using a mine roller assembly connected to a mine roller frame, the frame attached to a vehicle. The method propels the mine roller assembly across the underlying surface. The mine roller assembly has a wheel assembly rotatably connected to an arm pivotally connected to a bracket for attachment to the mine roller frame, and a spring and damper system extending between the bracket and the arm. The method applies a pressure from a pneumatic tire of the wheel assembly to the underlying surface, and maintains substantial contact between the pneumatic tire and the underlying surface due to the spring and damper system having a rebound damping rate which is higher than a compression damping rate to increase a ground following time of the tire. The mine detonates adjacent to the mine roller assembly and at a distance from the vehicle, thereby preserving the vehicle.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
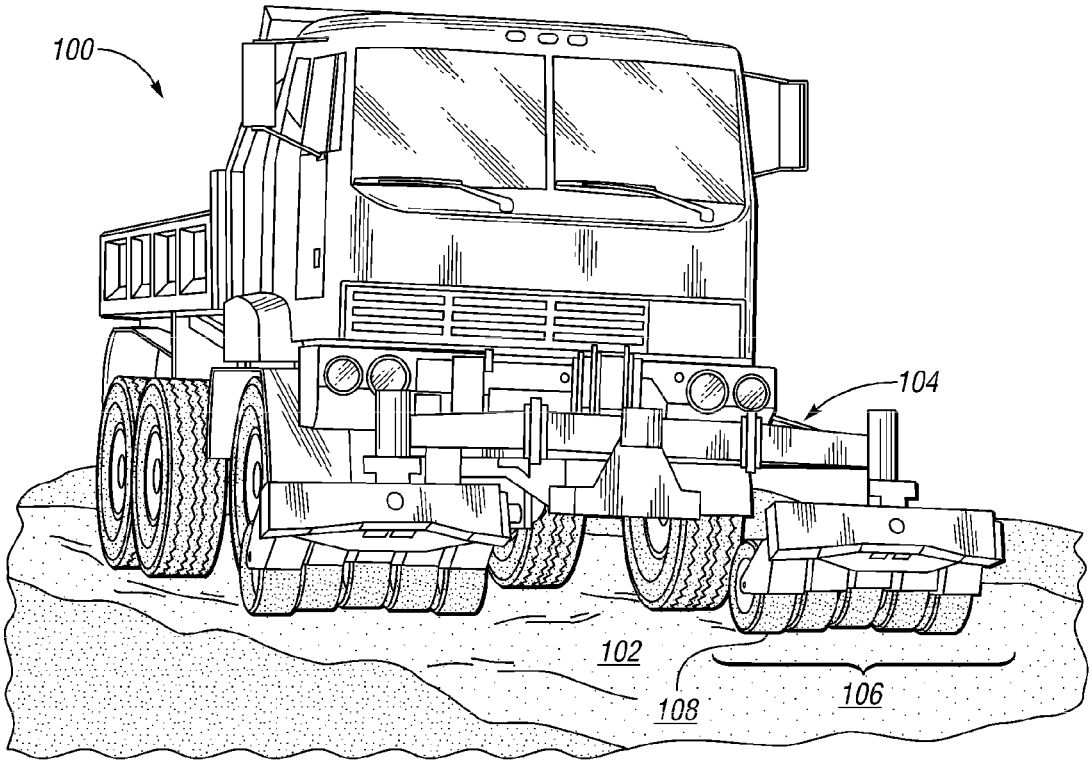
FIG. 1 is a perspective view of a vehicle with a mine roller and mine roller assemblies according to an embodiment.

FIG. 1 shows a vehicle 100 on an underlying surface 102, such as roads, fields, desert, and other types of terrain. The vehicle 100 may be a battle tank, armored vehicle, personnel carrier, or the like and be supported by wheels, tracks, or other devices as are known in the art on the ground 102. A mine roller 104 is attached to the front of vehicle 100. The mine roller 104 may be removably attached using various fasteners, such as bolts, or in another embodiment the mine roller 104 may be integrated into the vehicle 100 frame itself. The mine roller 104 is shown as having two banks 106 made up of several mine roller assemblies 108. Each mine roller assembly 108 is attached to the mine roller 104, and may be in contact with the ground 102. A vehicle 100 having any number of banks 106 arranged in any number configurations, such as a tricycle or quadricycle, is contemplated, as well as any number of assemblies 108 in a bank 106. In other embodiments, the mine roller assemblies 108 may be directly attached to the vehicle 100 itself. Alternatively, the mine roller 104 and bank 106 of mine roller assemblies 108 may extend behind the vehicle 100.

The mine roller assemblies 108 contact the underlying surface 102, and exert a force on the ground 102. This force is sufficient to detonate a mine or IED that may be placed on top of the ground 102, or buried within the ground 102. The mine roller assemblies 108 act to detonate or discharge the mine before the vehicle 100 reaches the mine. The mine is thereby discharged by the assemblies 108 at a distance from the vehicle 100 and may maintain the vehicle 100 usability and personnel safety.

Figure 2:
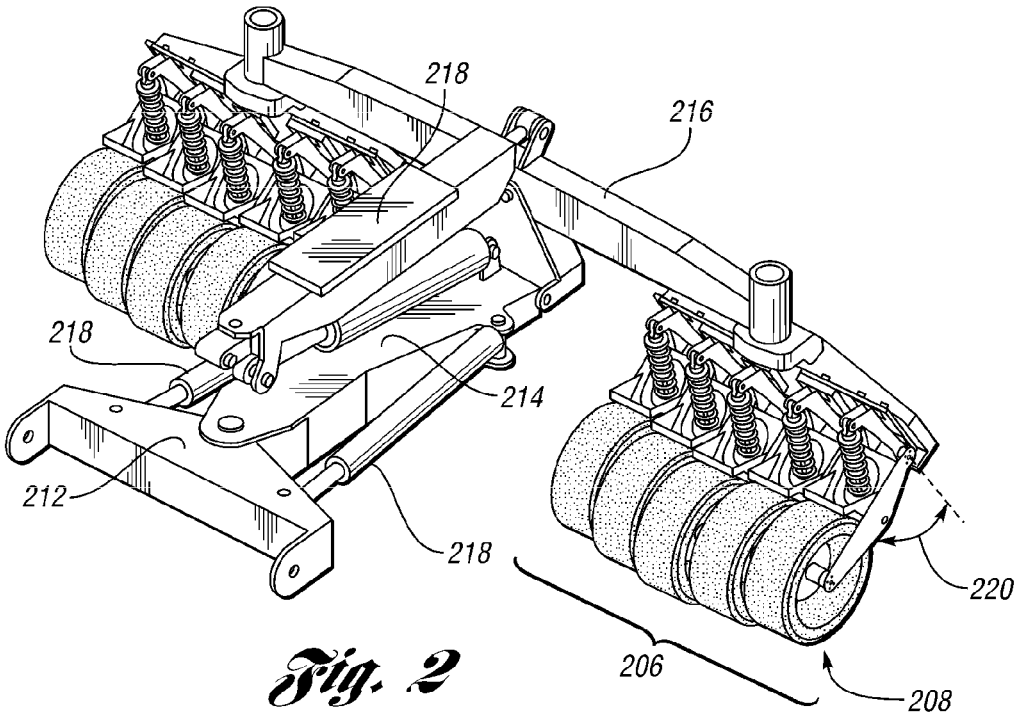
FIG. 2 is a perspective view of a mine roller and mine roller assemblies according to another embodiment.
Figure 3:
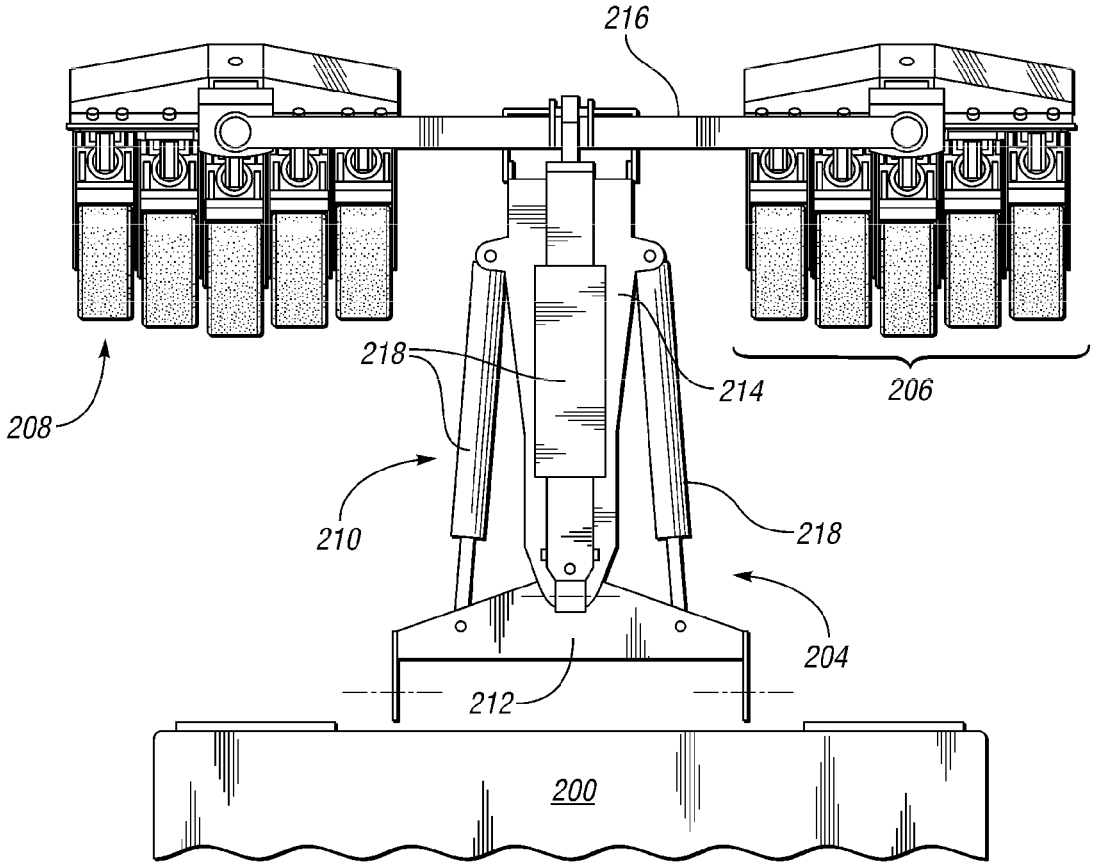
FIG. 3 is a top view of the mine roller and mine roller assemblies according to FIG. 2.

FIGS. 2 and 3 illustrate a mine roller 204 and banks 206 of assemblies 208 for use with a vehicle 200. The mine roller 204 has a frame 210. The frame 210 may include a metal or a composite material. The frame 210 has an attachment member 212, a longitudinal frame member 214, and a lateral frame member 216. The attachment member 212 connects the mine roller 204 to the vehicle 200, for example to the front bumper using bolts, other fasteners, welds or the like. The longitudinal frame member 214 may be pivotally connected to the attachment member 212, or affixed or welded to the attachment member 212 in other embodiments. The lateral frame member 216 is pivotally connected to the longitudinal frame member 214. The pivotal connections allow for the mine roller 204 to follow uneven terrain on the underlying surface and to track a curved path that the vehicle 200 may be taking through turning. Several hydraulic systems 218 are also provided. The hydraulic systems 118 assist the mine roller 204 through a turn or may lift the mine roller 204, and thereby the assemblies 208 from contacting the underlying surface 202 if desired. The hydraulic systems 218 may also provide a downforce, such as through a ram 219, to the assemblies 208 to bias them towards the ground 202.

Two banks 206 of mine roller assemblies 208 are shown in FIGS. 2-3. The banks 206 are spaced such that the mine roller assemblies 208 clear a path along the ground 202 in front of the vehicle 200 and along where the vehicle 200 wheels or tracks would pass. The mine roller assemblies 208 may be connected to the mine roller frame 210 at a predetermined caster angle 220.

Figure 4:
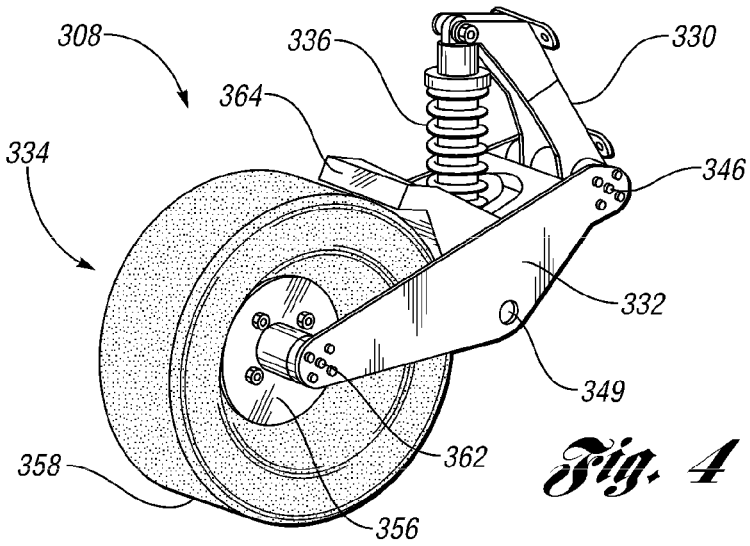
FIG. 4 is a perspective view of a mine roller assembly according to a further embodiment.
Figure 5:
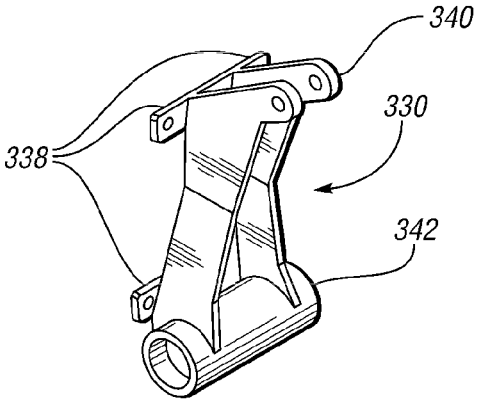
FIG. 5 is a perspective view of a bracket for the mine roller assembly of FIG. 4.

An individual mine roller assembly 308 is shown in FIG. 4, and components of the assembly 308 are shown in FIGS. 5-8. The assembly 308 may include a bracket 330, an arm 332, a wheel assembly 334, and a spring and damper system 336. The bracket 330, shown in FIGS. 4 and 5, is adapted to mount to the mine roller 304. The bracket 330 may have a series of attachment points 338 such as bolts holes used to attach the bracket 330 to the mine roller 304. The bracket 330 may also have attachment points 340 for a spring and damper system 336, and an additional attachment point 342 for the arm 332. Alternatively, either the mine roller 304 or the bracket 330 may have a series of attachment points 338 such that the bracket 330 may be adjusted relative to the mine roller 304 to extend the mine roller assembly 308 forwards or rearwards with respect to adjacent wheel assemblies or the mine roller 304. The adjustment of the wheel assembly in a longitudinal direction may increase the stability of the mine roller 304 as it travels across the ground 302.

Figure 6:
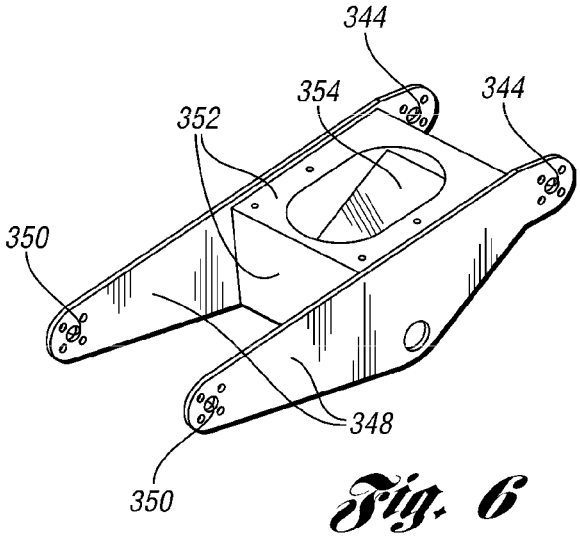
FIG. 6 is a perspective view of an arm for the mine roller assembly of FIG. 4.

The arm 332, as shown in FIGS. 4 and 6, has attachment points 344 to connect the arm 332 to the bracket 330. A shaft and bearing assembly 346 or other pivotal connection may be used to connect the arm 332 to the bracket 330. The arm 332 may extend into a fork 348, with attachment points 350 near the end of the fork 348. The wheel assembly 334 fits within the fork 348 and connects to the attachment points 350 on the arm 332. Alternatively, a series of attachment points 350 may be located on the arm 332, to adjust the wheel assembly 334 rearward or forward with respect to the mine roller 304 or adjacent mine roller assemblies. The spring and damper system 336 also mounts to the arm 332 via a pivotal connection such as a bolt with a bushing or washer, or with a bearing assembly 349. The arm 332 may have several cross members 352 for strength and additionally may have a guard 354. The guard 354 may provide a barrier between the ground 302 and the spring and damper system 336 such that in the event of a mine detonation, the spring and damper system 336 may be protected from impact from flying debris or shrapnel from the mine.

Figure 7:
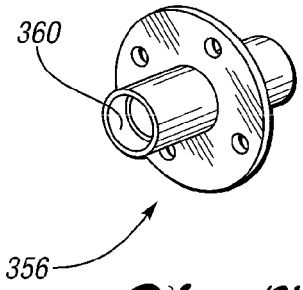
FIG. 7 is a perspective view of a wheel for the mine roller assembly of FIG. 4.

The wheel assembly 334 as shown in FIGS. 4 and 7 connects to the fork 348 of the arm 332 and includes a wheel 356 and tire 358. The wheel 356 may have a sleeve 360 for use with a shaft and bearing assembly 362 or the like to rotatably connect the wheel 356 and wheel assembly 334 to the fork 348 of the arm 332. A tire 358 attaches to the wheel 356. The tire 358 may be solid or pneumatic, and may include a run-flat tire to resist deflation when punctured, and allow the vehicle 300 and mine roller 310 to continue to be driven while detonating mines. The tire 358 may include a rubber compound and cording, or other materials as are known in the art. The tire 358 may be a highway-certified trailer tire, a turf tire, or others. A nearly rectangular profiled tire, or a tire with a relatively flat sidewall and low curvature may be used, which may increase the surface area contact patch of the tire 358 with the ground 302.

Figure 8:
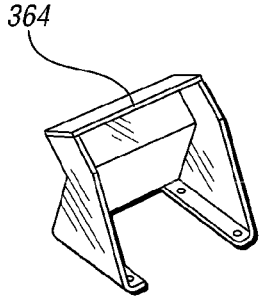
FIG. 8 is a perspective view of a shield for the mine roller assembly of FIG. 4.

A shield 364 is shown in FIGS. 4 and 8 that may be used with a mine roller assembly 308. The shield 364 may be attached to the arm 332 using fasteners such as bolts, rivets, through welding, or the like. The shield 364 may provide a barrier between the wheel assembly 334 and the spring and damper system 336 such that the spring and damper system 336 may be protected from impact during a mine detonation.

The bracket 330, arm 332, shield 364, and wheel 356 may be made of various materials including metals such as steel or aluminum alloys, composites, or the like.

Figure 9:
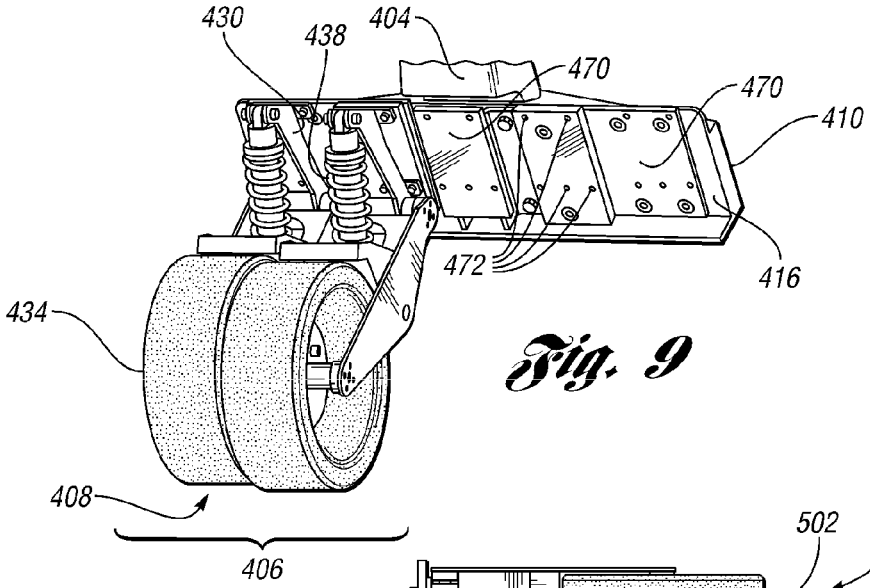
FIG. 9 is a perspective view of a mine roller system according to yet another embodiment.

FIG. 9 shows a mine roller bank 406. The mine roller bank 406 has several adaptor plates 470 and several mine roller assemblies 408 that connect to the mine roller frame 410. The mine roller bank 406 is shown as having two mine roller assemblies 408 installed, and spaces for an additional three mine roller assemblies 408. Of course, any number of mine roller assemblies 408 in a bank 406 is contemplated. The mine roller assemblies 408 may be individually attached to the mine roller 404 such that they may be individually removed for service, repair, or replacement or other as needed. If an assembly 408 is damaged due to a mine detonation, it may be replaced without removing the remaining assemblies 408 in the bank 406, and the vehicle 400 may return to service quickly. The assembly 408 may be replaced while the vehicle 400 is in the field without the need for a shop or a trained mechanic.

The adaptor plates 470 may be used to mount the assemblies 408 onto the mine roller 404. The adaptor plates 470 bolt or fasten onto the lateral frame member 416. The adaptor plates 470 also may have a bolt pattern 472 corresponding to the bracket 430 bolt pattern 438, and the bracket 430 is thereby mounted to the adaptor plate 470. The adaptor plates 470 may be used if retrofitting an existing mine roller 404, for example. The adaptor plates 470 additionally may be used to create offsets between the mine roller assemblies 408 and between the corresponding wheel assemblies 434, and may reduce gaps between the mine roller assemblies.

Figure 10:
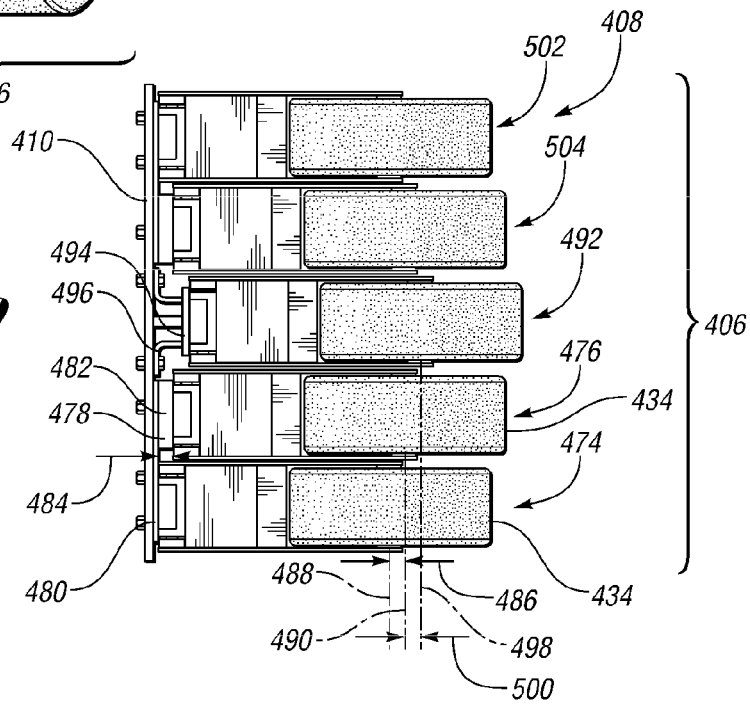
FIG. 10 is a top view of a mine roller system according to another embodiment.

An embodiment of a bank 406 of assemblies 408 is shown in FIG. 10. Five mine roller assemblies 408 are shown attached to a mine roller frame 410. Of course, any number of mine roller assemblies 408 could be used, and may be connected to a vehicle 400. A first assembly 474 and second assembly 476 are connected to the mine roller 404 using an adaptor plate 478. The first assembly 474 connects to first portion 480 of the plate 478. The second assembly 476 connects to a second portion 482 of the plate 478. Portions 480, 482 have different thicknesses, leading to a offset distance 484 between the mounting surface of portions 480, 482. The offset 484 provides for an offset 486 between an axis of rotation 488 about the wheel assembly 434 of the first assembly 474 and the axis of rotation 490 of the wheel assembly 434 of the second assembly 476. Offset 486 may be the same distance as offset 484.

A third mine roller assembly 492 is connected to the mine roller 410 using adaptor plate 494. Plate 494 may be a single plate, and additionally may have a bracket 496 to mount the plate 494 to the mine roller 410. Adaptor plate 494 may allow for the third assembly 492 to be offset from the first and second assemblies 474, 476 as shown. The wheel assembly 434 of the third assembly 492 has an axis of rotation 498, and may have an offset distance 500 from the second axis of rotation 486. Offset distance 500 may be the same as offset 486, or may be different.

A fourth and fifth mine roller assembly 502, 504 are attached to the mine roller 404 and may mirror the first and second mine roller assemblies 474, 476, thereby forming a chevron pattern based on the positioning of the assemblies 474, 476, 492, 502, 504. Alternatively, the mine roller assemblies 408 in the bank 406 may be arranged such that they form a linear pattern with a slope, with offsets between the wheel assemblies 434 being the same, or varying between them. Alternatively, the wheel assemblies 434 may be arranged non-linearly, such as along an exponential or other curve. Alternatively, one or both outside mine rollers 474, 502 may be extended rearwards by modifying the attachment point for the arm or wheel assembly 434, or by adding an additional extension piece, which can aid in the stability of the bank of mine rollers 406. The mine rollers 474, 502 are adjusted using a series of apertures and pin system.

Two or more adjacent wheel assemblies 434 may mount to a single adaptor plate 470 with a stepped surface to provide the offset. Alternatively, each wheel assembly 434 may have an individual adaptor plate 470, with a specified thickness to provide the offset. Of course, any combination of adaptor plates 470 is contemplated.

Referring back to FIG. 4, the spring and damper system 336 may be a coilover spring and shock, an air shock, or the like. The air shock may have a nitrogen or other gas charge to provide a spring rate and take the place of a coil spring. The spring and damper system 336 may have a compression damping rate and a rebound damping rate. The compression and rebound damping rates may be different from one another based on the performance needed.

Figure 11:
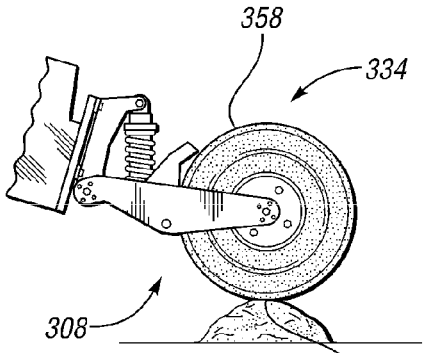
FIG. 11 is a side view of a mine roller assembly during a half round impact.
Figure 12:
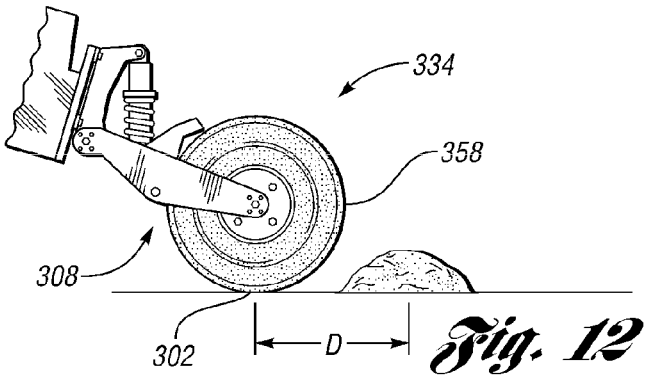
FIG. 12 is a side view of the mine roller assembly of FIG. 11 during the half round impact at a later time.

A rebound damping rate that is higher than the compression damping rate may be used in some embodiments in order to increase a ground following time of the wheel assembly with an underlying surface. The ground following time is the time in which the tire is in contact with the underlying surface or ground 302. FIGS. 11 and 12 depict a test where a mine roller assembly 308 moves across uneven terrain or obstacles on the ground 302. In the test shown, a half-round section was used as the obstacle. The wheel assembly 334 may bounce with the tire 358 leaving the ground for a period of time. Since the vehicle 300 is moving, the tire 358 would lose contact with the ground 302 for a skip distance D over the period of time. Increasing the ground following time of the tire 358 may lead to better mine detonation rates, by increasing the time and distance that the tire is in contact with the ground 302 and able to detonate a mine. FIG. 11 shows the tire 358 just as it has reached the top of the obstacle. FIG. 12 shows the tire 358 just as it has reached the ground 302 at a later time, and at a skip distance D from the obstacle. As the skip distance D increases, the ground following time would decrease, and the potential for the wheel assembly missing a mine may also increase.

The weight of the mine roller assembly 308, tuning the characteristics of the spring and damper system 336, including spring rate, compression damping rate, and rebound damping rate, the use of a pneumatic tire 358, and using multiple wheel assemblies 308 are some ways in which ground following times may be increased.

A dynamic model was created of the mine roller assembly 308, the model incorporates vehicle effects and the effect of the hydraulic ram 318 used for applying downforce. The single-arm model was used to determine ground-following performance, based on running the model at various speeds over a simulated 1-inch RMS course. Roller arm spring rate, shock compression damping, and shock rebound damping for the spring and damper system 336 were used as input variables. The shock and spring settings used in modeling are shown in Table 1.

TABLE 1

Shock and Spring Settings

| Suspension Setup | Spring Rate (lb/in) | Damping Rate (lb/in/s) Compression | Damping Rate (lb/in/s) Rebound |
|---|---|---|---|
| 1 | 275 | 11.3 | 32.4 |
| 2 | 275 | 11.3 | 16 |
| 3 | 275 | 5.8 | 32.4 |
| 4 | 275 | 5.8 | 16 |
| 5 | 500 | 11.3 | 32.4 |
| 6 | 500 | 11.3 | 16 |
| 7 | 500 | 5.8 | 32.4 |
| 8 | 500 | 5.8 | 16 |

Table 2 lists some dynamic model results for the total time off ground and percent of time off ground, averaged across five assemblies 408 in a bank 406 for each spring and damper 336 configuration in Table 1. The results shown are for modeled 20 mile-per-hour runs across the RMS course, 500 feet in length.

TABLE 2

Dynamic Model Results

| Configuration (Suspension Setup) | Course Length (ft) | Total Run Length (s) | Total time off ground (s) | % Time off ground |
|---|---|---|---|---|
| 1 | 500 | 17.05 | 1.8640 | 10.93% |
| 2 | 500 | 17.05 | 1.1770 | 6.90% |
| 3 | 500 | 17.05 | 1.7030 | 9.99% |
| 4 | 500 | 17.05 | 1.5980 | 9.37% |
| 5 | 500 | 17.05 | 1.8990 | 11.14% |
| 6 | 500 | 17.05 | 1.7800 | 10.44% |
| 7 | 500 | 17.05 | 1.7900 | 10.50% |
| 8 | 500 | 17.05 | 1.7190 | 10.08% |
| Stock | 500 | 17.05 | 6.0113 | 35.26% |

Experimental testing was conducted on a single mine roller assembly 308. The tests were conducted on a gravel road with a surface-laid SIM (simulated instrumented mine) to minimize the variability of the soil overburden to provide a direct comparison between the different suspension configurations. Half-round impact testing (as in FIGS. 11-12) was also conducted. For example, suspension set-up #6 (See Table 1) had a skip distance of 9.3 inches after the half round impact of those tested. A stock production roller was tested as well and had a skip distance of 21 inches after the half round impact.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Additionally, features of various implementing embodiments may be combined to form further embodiments of the invention.

What is claimed:

1. A mine roller assembly for a mine roller that detonates mines located in or on an underlying ground surface, the assembly comprising:

a bracket configured for attachment to a mine roller system frame, the bracket having a first end region and a second end region;

an adaptor plate for connection of the bracket to the mine roller frame;

an arm having a first end region and a second end region, the first end region of the arm being pivotally connected to the first end region of the bracket;

a spring and damper system extending between the second end region of the bracket and the second end region of the arm; and a wheel assembly directly connected to the second end region of the arm, the wheel assembly configured to interact with the underlying surface.

2. The mine roller assembly of claim 1 wherein the wheel assembly includes a pneumatic wheel.

3. The mine roller assembly of claim 2 wherein the pneumatic wheel assembly includes a run-flat tire.

4. The mine roller assembly of claim 1 wherein the spring and damper system has a compression damping rate and a rebound damping rate.

5. The mine roller assembly of claim 4 wherein the rebound damping rate is higher than the compression damping rate to increase a ground following time of the wheel assembly with an underlying surface.

6. The mine roller assembly of claim 1 further comprising a guard extending from the arm, the guard providing a barrier between the wheel assembly and the spring and damper system.

7. The mine roller assembly of claim 1 wherein the arm further includes a shield for providing a barrier between the spring and damper system and the underlying surface.

8. A mine roller assembly for use on a mine roller vehicle that detonates mines located in or on an underlying ground surface, the mine roller assembly comprising:

a bracket having a first end region and second end region, the bracket having first and second attachment points for connecting the mine roller assembly to a mine roller vehicle frame, the first attachment point adjacent to the first end region and the second attachment point adjacent to the second end region;

an arm having a first end region, a second end region, and an intermediate region therebetween, the second end region of the arm pivotally connected to the second end region of the bracket;

a wheel assembly connected to the first end region of the arm for rotation about an axis extending through the first end region of the arm; and a spring and damper system extending between the first end region of the bracket and the intermediate region of the arm, the spring and damper system having a rebound damping rate and a compression damping rate, wherein the rebound damping rate is higher than the compression damping rate to increase a ground following time of the wheel assembly with an underlying surface.

9. The mine roller of claim 8 wherein the spring and damper system includes a coil-over spring and shock.

10. The mine roller assembly of claim 8 wherein the spring and damper system includes an air shock.

11. The mine roller assembly of claim 8 further comprising a guard extending from the arm, the guard providing a barrier between the wheel assembly and the spring and damper system.

12. The mine roller assembly of claim 8 wherein the arm further includes a shield for providing a barrier between the spring and damper system and the underlying surface.

13. A mine roller system for detonating mines located in or on an underlying ground surface comprising:

a vehicle having a chassis and a series of traction devices;

a frame adapted for attachment to the vehicle, the frame having a longitudinal member and a lateral member; and a mine roller assembly having:

a bracket configured for attachment to the frame, the bracket having a first end region and a second end region, an arm having a first end region and a second end region, the first end region of the arm being pivotally connected to the first end region of the bracket, a spring and damper system extending between the second end region of the bracket and the second end region of the arm, and a wheel assembly directly connected to the second end region of the arm about an axis of rotation, the wheel assembly configured to interact with the underlying surface.

14. The mine roller system of claim 13 wherein the mine roller assembly is a first mine roller assembly, the mine roller assembly further comprising:

a second mine roller assembly having:

a bracket configured for attachment to the frame, the bracket having a first end region and a second end region, an arm having a first end region and a second end region, the first end region of the arm being pivotally connected to the first end region of the bracket, a spring and damper system extending between the second end region of the bracket and the second end region of the arm, and a wheel assembly directly connected to the second end region of the arm about an axis of rotation, the wheel assembly configured to interact with the underlying surface;

wherein the axis of rotation of the first mine roller assembly is offset from the axis of rotation of the second mine roller assembly.

* * * * *